US005219622A

United States Patent [19]

Meier

[11] Patent Number: 5,219,622

[45] Date of Patent: Jun. 15, 1993

[54] METHOD OF FORMING A SHEET OF MATERIAL WITH INDICIA

[75] Inventor: Waldemar Meier, Munich, Fed. Rep. of Germany

[73] Assignee: Raychem GmbH, Fed. Rep. of Germany

[21] Appl. No.: 847,066

[22] PCT Filed: Oct. 9, 1990

[86] PCT No.: PCT/GB90/01556

§ 371 Date: Apr. 9, 1992

§ 102(e) Date: Apr. 9, 1992

[87] PCT Pub. No.: WO91/05323

PCT Pub. Date: Apr. 18, 1991

[30] Foreign Application Priority Data

Oct. 9, 1989 [GB] United Kingdom ..... 8922724

[51] Int. Cl.[5] ..... B05D 3/06

[52] U.S. Cl. ..... 427/466; 427/180; 427/261; 427/288; 427/375; 427/386; 427/391; 427/411; 427/470; 427/559

[58] Field of Search ..... 427/466, 180, 261, 288, 427/375, 386, 391, 411, 470, 559

[56] References Cited

U.S. PATENT DOCUMENTS

| | | | |
|---|---|---|---|
| 3,130,064 | 4/1964 | Insalaco | 117/17.5 |
| 3,906,138 | 9/1975 | Evensen | 428/320 |
| 4,245,025 | 1/1981 | Kato et al. | 427/146 X |

FOREIGN PATENT DOCUMENTS

| | | |
|---|---|---|
| 104626 | 4/1984 | European Pat. Off. . |
| 237258 | 9/1987 | European Pat. Off. . |
| 281354 | 9/1988 | European Pat. Off. . |
| 2844691 | 4/1979 | Fed. Rep. of Germany . |

*Primary Examiner*—Bernard Pianalto

*Attorney, Agent, or Firm*—Herbert G. Burkard; Sheri M. Novack

[57] ABSTRACT

A method of forming a sheet of material with indicia thereon comprises applying indicia to the sheet by an electrostatic copying process in which a toner powder is deposited on the sheet and is heated to cause it to fuse. The sheet of material comprises a flexible support layer that is provided with a porous coating of a latent curable material, preferably in particulate and/or filamentary form and especially one based on an epoxy material.

It has been found that the indicia are more indelible than those formed on other surfaces by the same process even though the fused toner is not absorbed by the curable material.

17 Claims, No Drawings

METHOD OF FORMING A SHEET OF MATERIAL WITH INDICIA

This invention relates to the formation of indicia on sheets of material, for example alphanumeric indicia, designs or both.

European patent application serial No. 237,258, the disclosure of which is incorporated herein by reference, describes a marker assembly having a support layer and a porous coating of a latent curable material that is capable of receiving printed indicia and which can subsequently be cured to render the indicia substantially indelible. The porous coating may be in particulate or filamentary form or both, but preferably is in particulate form, having particles of weight average particle size of not more than 100 micrometers, more preferably not more than 50 micrometers and especially not more than 25 micrometers, the preferred coatings having a particle size of less than 10 micrometers. The preferred materials for use as the coatings are ones in which the latency of the curing reaction is achieved by processing the reactive components of the coating into separate particles and mixing the particles together to form the coating, so that the particles will exist separately from one another until they are heated whereupon they will fuse and react. The marker assembly is preferably heated to a temperature of 150° to 170° C. for a period of up to 7 minutes in order to cause the particles to melt and coalesce in order that the components may react. As mentioned in the above patent specification, whether or not the indicia are substantially indelible will depend, among other things on the ink that is used to form the indicia and in particular on whether it is absorbed or rejected by the curable marker coating material in to uncured state, only those inks that are absorbed by the marker coating being considered appropriate for use with that marker.

Although it is possible to form very good and permanent graphics and alphanumeric indicia on these markers, this is achieved by the use of a personal computer with appropriate printer and software, which can be relatively expensive, especially if such cables are required only on an occasional basis.

We have now found, however, that a significant degree of permanency or indelibility of indicia can be achieved by forming them on a curable porous surface such as described above by means of an electrostatic copying process. Thus, according to the present invention, there is provided a method of forming a sheet of material with indicia thereon, which comprises applying indicia to the sheet by an electrostatic copying process in which a toner powder is deposited on the sheet and is then heated to fuse the toner, the sheet of material comprising a flexible support layer that is provided with a porous coating of a latent curable material that is in particulate and/or filamentary form.

Surprisingly, the indicia formed according to the invention are significantly more indelible than electrostatically copied indicia on other surfaces such as paper and the like, notwithstanting the fact that the fused toner used in the electrostatic copying process is not absorbed substantially by the curable material but instead tends to remain on the surface of it. The material is significantly more resistant to abrasion than electrostatically copied images on other common materials such as paper, both when dry and when in the presence of a variety of solvents. Furthermore, we have found that the quality of the formed indicia is improved if it is subjected to no further heating step after the toner has been caused to fuse: If the sheet of material is subjected to the normal heating or "permatising" step it is possible for surface imperfections to be generated in the printed areas. Thus, the total length of time for which heat is applied will usually be not more than 2 and especially not more than 1 second, so that the total heat applied to the sheet of material is insufficient to cure the material or to melt the particles or filaments although some sintering of the particles may occur.

The sheet of material should be flexible in order to enable it to be passed through an electrostatic copier, and preferably has a total thickness of not more than 0.5 mm and especially not more than 0.2 mm. The latent curable material may be supported by any flexible backing layer that can be passed through copying apparatus for example paper, card or a thin film of plastics material e.g. aromatic ether ketones e.g. polyesters especially polythylene terephthalate for example sold under the trademark "Mylar" or other polyesters e.g. "Hytrel", polyolefins, fluoropolymers such as polyvinylidine fluoride, polyamides such as nylon 6, nylon 6.6, nylon 11 or nylon 12 and other polymers or metals. The material may be modified if desired to provide it with additional properties, for example the material may incorporate halogenated or halogen-free flame retardants, especially halogen free flame retardants such as hydrated alumina or hydrated magnesia. The material may incorporate additional or alternative fillers in order to pigment it, especially to form a white layer.

It may be preferred to cross-link the support layer either chemically or by irradiation e.g. by gamma radiation or by high energy electrons in order to improve the layer's resistance to heat. In a typical chemically cross-linked composition there will be about 0.5 to 5 weight percent of peroxide based on the weight of the polymeric composition. The cross-linking agent may be employed alone or in association with a co-curing agent such as a polyfunctional vinyl or allyl compound, e.g. triallyl cyanurate, triallyl isocyanurate or pentaerythritol tetra methacrylate.

Radiation cross-linking may be effected by exposure to high energy irradiations such as an electron beam or gamma rays. Radiation dosages in the range of 2 to 80 Mrads, preferably 2 to 50 Mrads, e.g. 2 to 20 Mrads and particularly 4 to 15 Mrads are in general appropriate.

For the purpose of promoting cross-linking during irradiation preferably from 0.2 to 5 weight percent of a proprad such as a polyfunctional vinyl or allyl compound, for example, triallyl cyanruate, triallyl isocyanurate or pentaerythritol tetramethacrylate are incorporated into the composition prior to irradiation.

The process according to the invention is especially appropriate to the formation of labels and signs intended to be used in buildings and or machinery or other equipment, for example as faceplates etc. The sheet may consist solely of the latent curable material and the support layer, or it may include other layers such as an adhesive layer and if necessary a release film, in order to facilitate adhesion to the surface marked. The adhesives may include hot-melt adhesives, cyanoacrylate adhesives, contact adhesives or pressure-sensitive adhesives e.g. acrylic adhesives.

I claim:

1. A method of forming a sheet of material with indicia thereon, which comprises applying indicia to the sheet by an electrostatic copying process in which a toner powder is deposited on the sheet and is then heated to fuse the toner, the sheet of material comprising a flexible support layer that is provided with a porous coating of a latent curable material, that is in particulate and/or filamentary form.

2. A method as claimed in claim 1, wherein the sheet of material is subjected to no further heating step after the toner has been caused to fuse.

3. A method as claimed in claim 2, wherein the total heat applied to the sheet of material is insufficient to cure the latent curable material.

4. A method as claimed in claim 2, wherein the sheet of material has a thickness of not more than 0.5 mm.

5. A method as claimed in claim 2, wherein the latent curable material is in particulate and/or filamentary form.

6. A method as claimed in claim 2, wherein more than one toner is employed to form an image of more than one color.

7. A method as claimed in claim 1, wherein the total heat applied to the sheet of material is insufficient to cure the latent curable material.

8. A method as claimed in claim 7, wherein the sheet of material has a thickness of not more than 0.5 mm.

9. A method as claimed in claim 7, wherein the latent curable material is in particulate and/or filamentary form.

10. A method as claimed in claim 7, wherein more than one toner is employed to form an image of more than one color.

11. A method as claimed in claim 1, wherein the sheet of material has a thickness of not more than 0.5 mm.

12. A method as claimed in claim 11, wherein the latent curable material is in particulate and/or filamentary form.

13. A method as claimed in claim 11, wherein more than one toner is employed to form an image of more than one color.

14. A method as claimed in claim 1, wherein the latent curable material is in particulate and/or filamentary form.

15. A method as claimed in claim 14, wherein more than one toner is employed to form an image of more than one color.

16. A method as claimed in claim 1, wherein more than one toner is employed to form an image of more than one color.

17. A method as claimed in claim 16, wherein more than one toner is employed to form an image of more than one color.

* * * * *